US007356871B2

(12) United States Patent
Heaven

(10) Patent No.: US 7,356,871 B2
(45) Date of Patent: Apr. 15, 2008

(54) DUAL SIZED BROOM AND DUST PAN

(76) Inventor: Jonathan Mark Heaven, P.O. Box 156 STN Main, Delta, B.C. (CA) V4K 3N4

( * ) Notice: Subject to any disclaimer, the term of this patent is extended or adjusted under 35 U.S.C. 154(b) by 163 days.

(21) Appl. No.: 11/384,908

(22) Filed: Mar. 21, 2006

(65) Prior Publication Data

US 2007/0220695 A1 Sep. 27, 2007

(51) Int. Cl.
*A47L 13/52* (2006.01)
*A46B 5/00* (2006.01)
*B25G 1/04* (2006.01)

(52) U.S. Cl. ..... 15/257.2; 15/257.4; 15/257.7; 15/143.1; 15/144.3; 16/110.1; 16/429

(58) Field of Classification Search ..... 15/143.1, 15/144.3, 144.4, 104.8, 257.1, 257.2, 257.4, 15/257.7; 16/110.1, 429, 436
See application file for complete search history.

(56) References Cited

U.S. PATENT DOCUMENTS 3,029,455 A * 4/1962 Siculan ..... 15/159.1
4,257,635 A * 3/1981 Mainprice ..... 294/1.4
5,379,481 A * 1/1995 DeMars ..... 15/257.4
5,661,868 A * 9/1997 Panagakos et al. ..... 15/184
6,199,285 B1 * 3/2001 Sheehan ..... 30/324
6,705,654 B2 * 3/2004 Slauf ..... 294/24
2006/0200924 A1 * 9/2006 Hampton ..... 15/144.3

FOREIGN PATENT DOCUMENTS

FR 2523501 * 9/1983
JP 10-262890 * 10/1998

* cited by examiner

*Primary Examiner*—Mark Spisich

(57) ABSTRACT

A long handled cleaning implement such as a broom that is provided with a collapsible handle that can be used as a mini sweeping broom. This collapsible ability will also permit compact storage, a cooperating accessory dustpan is provided which the collapsible cleaning implement is stored into. When removed from the compact position the handle of the cleaning implement quickly and easily extends to a full length rigid position for use. In combination this provides the operator the choice of a large area cleaning or a small area hand sweep and the convenience of compact storage or transportation.

1 Claim, 5 Drawing Sheets

DUAL SIZED BROOM AND DUST PAN

BACKGROUND OF THE INVENTION

1. Field of the Invention

This invention relates to residential and commercial cleaning implements and, in particular, relates to collapsible handle cleaning implements such as brooms or mops and accessory systems therefore.

2. Description of the Prior Art

With real estate prices ever escalating, there has been an increasing trend for people to live in smaller homes and to work in smaller premises than was previously the norm. These smaller environments typically provide reduced storage space, especially for larger items. In a residential context, the traditional full height "broom closet" is now often found only in larger size homes and is often absent in smaller types of living accommodation such as condominiums, town homes, mobile homes and the like. As a result of the reduced amount of available storage area a premium is put on what storage areas exist, and as a result, numerous products have been introduced to take better advantage of these areas. These products include closet and cupboard organizers, cleaning utensils, and other implements designed to be stored in small spaces. Many cleaning implements employed in both residential and commercial contexts such as brooms, mops and dusters have full length handles and require a broom closet or other similarly sized areas which to store the implement when it is not in use. As storage space of sufficient size for these implements are increasingly more often not present, the implement is often stored in a coat closet or in a basement or often simply in the corner of a room. It would therefore be desirable to have a cleaning implement with a full length handle such as a broom, mops, dusters or the like that contained a collapsible handle means such that the implement could be stored in very small spaces such as in a cupboard or underneath the kitchen sink. This would also permit such cleaning implements to be stored in automobiles, mobile homes, boats and other vehicle, and or will as in any other application having limited storage space. It would also be desirable to have any normal accessories for such cleaning implements, i.e. a dust pan to be used in conjunction with the collapsed cleaning implement as a compact unit. This would provide even more efficient use of storage area as will as providing the user with added convenience.

SUMMARY OF THE INVENTION

It is an object of the present invention to provide a cleaning implement such as broom with a full sized handle that is capable of being easily and quickly collapsed for use as a mini sweeping broom. It is a further object of the present invention to provide an accessory dust pan to said cleaning implements that is designed to be stored in conjunction with said cleaning implement as a compact unit. It is still a further object of the present invention to provide a full size broom that when in a collapsible state, is stored with the bristles of the broom being enclosed in a co-operating dust pan in such a manner so as to prevent the escape of dirt or other matter to the surrounding area. It is still a further object of the present invention to provide a collapsible cleaning implement and accessory that are durable and inexpensive to manufacture, and easy to use. Thus in the invention there is provided a cleaning implement with a full size handle, comprising at least two if not more handle sections, one end of the handle sections is decreased in diameter so as to permit the slidable insertion into the adjoining handle section end to form a rigid full size handle. An internal connection means, such as a flexible elastic cord is used as a means to assist in the extension of the handle from the collapsed position to the extended and locked position and also provides the means to keep the handle sections connected together when the handle is in the collapsed position. Accessories to the cleaning implement is provided and is designed so that they can be stored together with the cleaning implement in a compact unit. Accessories provides mounting and holding means incorporated into its structure such as clips, hangers or hook or loop straps. Further features of the invention will be described or will become apparent in the course of the following detailed description.

BRIEF DESCRIPTION OF THE DRAWINGS

In order that the invention may be clearly understood, the preferred embodiment thereof will now be described in detail by way of example, with reference to the accompanying drawings, in which.

DESCRIPTION OF THE PREFERRED EMBODIMENTS

Figure 1:
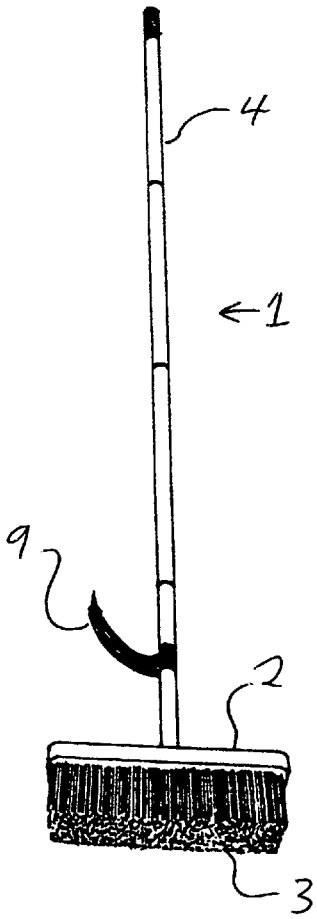
FIG. 1 is a three dimensional view of the collapsible broom in its fully extended position
Figure 2:
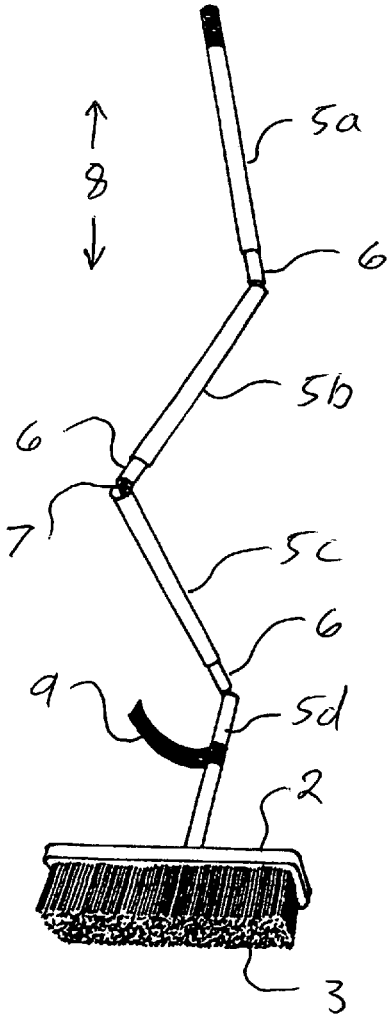
FIG. 2 is a three dimensional view of the collapsible broom in a partially collapsed position showing the separate handle sections and the internal connecting means which runs throughout the length of the broom handle.

Referring to FIG. 1, in the described embodiment of the present invention there can be seen a long handled cleaning implement 1. In the described embodiment of the present invention, a long handle 4 is shown connected to a broom head 2 having bristles 3 thus defining a long handled cleaning implement 1 made out of suitable materials, referred to from now on as a broom 1. The long handle 4 is made up of several similarly dimensioned handle sections referred to as handle sections 5*a*, 5*b*, 5*c*, and 5*d* as shown in FIG. 2. In the preferred embodiment of the present invention the handle sections 5*a*, 5*b*, 5*c* and 5*d* are of a generally cylindrical shape and are predominantly hollow throughout.

Figure 3:
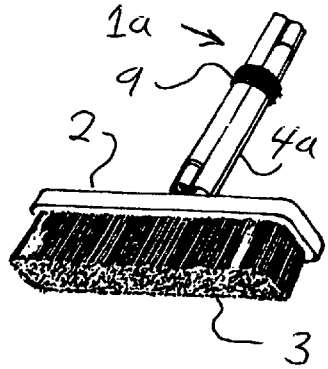
FIG. 3 is a three dimensional view of the collapsible broom in the fully collapsed position.
Figure 4:
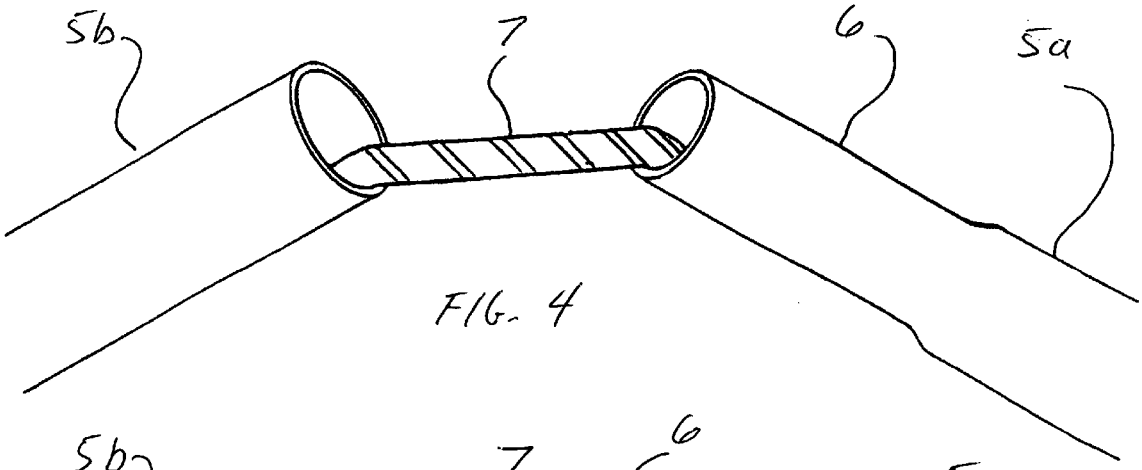
FIG. 4 is a three dimensional view of the joints between the two adjoining handle sections when the sections are separated and showing the internal elastic cord of the collapsible broom.
Figure 5:
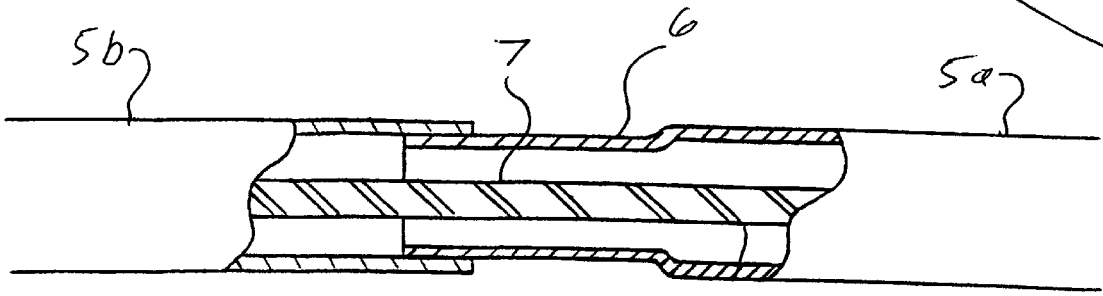
FIG. 5 is a cross sectional view of two interlocking joints from one handle section to another in a partially interlocked relation and showing a connecting internal elastic cord of the collapsible broom.
Figure 6:
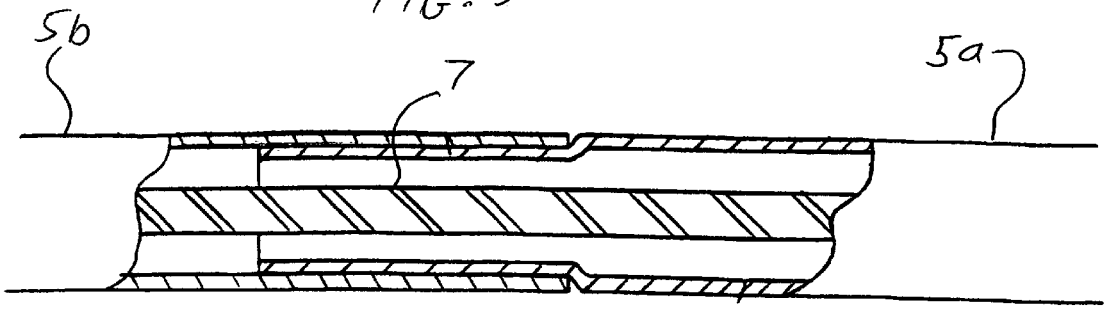
FIG. 6 is a cross sectional view of two interlocking joints from one handle section to another in an interlocked relation and showing a connecting internal elastic cord of the collapsible broom.

The handle sections 5*a*, 5*b* and 5*c* each have their lower end 6 which is closest to the broom head 2 a short section having a reduced outside diameter as compared to the balance of the handle sections 5*a*, 5*b*, 5*c* and 5*d* as shown in FIG. 2. Referring to FIG. 4, there can be seen an enlarged view as an example the adjoining handle sections 5*a* and 5*b*. The handle section 5*a* can be seen to have a short section of a reduced diameter at the lower end 6. This shorter section of handle sections 5*a* is adapted to be slidable into and slidable removable from the adjoining handle sections 5*b* creating a snug fit as shown in FIG. 5 and FIG. 6. The handle sections 5*a*, 5*b*, 5*c* and 5*d* are connected to each other by an internal connecting means, typically being a flexible elastic material which is commonly known as a bungy cord 7 as shown in FIG. 4, FIG. 5 and FIG. 6. The bungy cord 7 is connected to the uppermost of handle section 5*a* and lowermost of the handle sections 5*d* by any appropriate fastening means. The bungy cord 7 is partially stretched so as to provide an elastic pull to the handle sections 5*a*, 5*b*, 5*c*, and 5*d* so that when the cleaning implement is in a fully extended position there is an elastic compressive force exerted on the long handle 4 which resists separation when the broom 1 is being used as a cleaning implement. After this operation the handle sections 5*a*, 5*b*, 5*c* and 5*d* can be stretched apart 8 from each other as shown in example in FIG. 2 and folded along side of each other thus creating the short handle 4*a* as shown in FIG. 3 and still remain connected to each other creating a different cleaning implement referred to as broom 1*a*. To maintain the handle sections 5*a*, 5*b*, 5*c*, and 5*d* in this short handle 4*a* configuration, a retaining means is provided such as a hook and loop strap 9 which is connected to handle sections 5*d* show in FIG. 1 and FIG. 2 which is wrapped around the handle sections 5*a*, 5*b*, 5*c*, and 5*d* which is shown in FIG. 3. These two choices allows the operator the convenience of sweeping large areas with the broom 1 or concentrated areas with the broom 1*a*.

Figure 7:
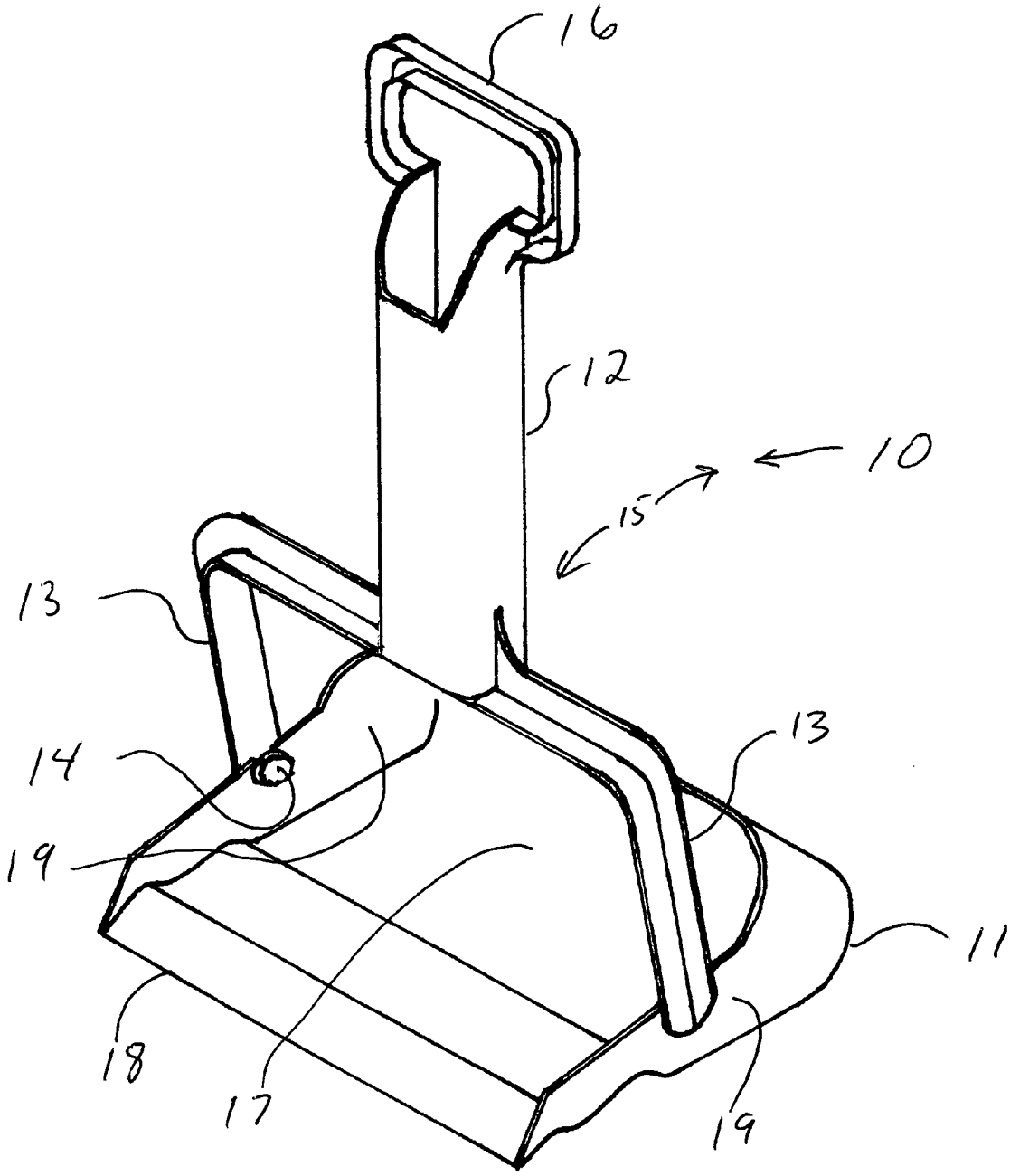
FIG. 7 is a three dimensional view of a dust pan in an operative position.
Figure 8:
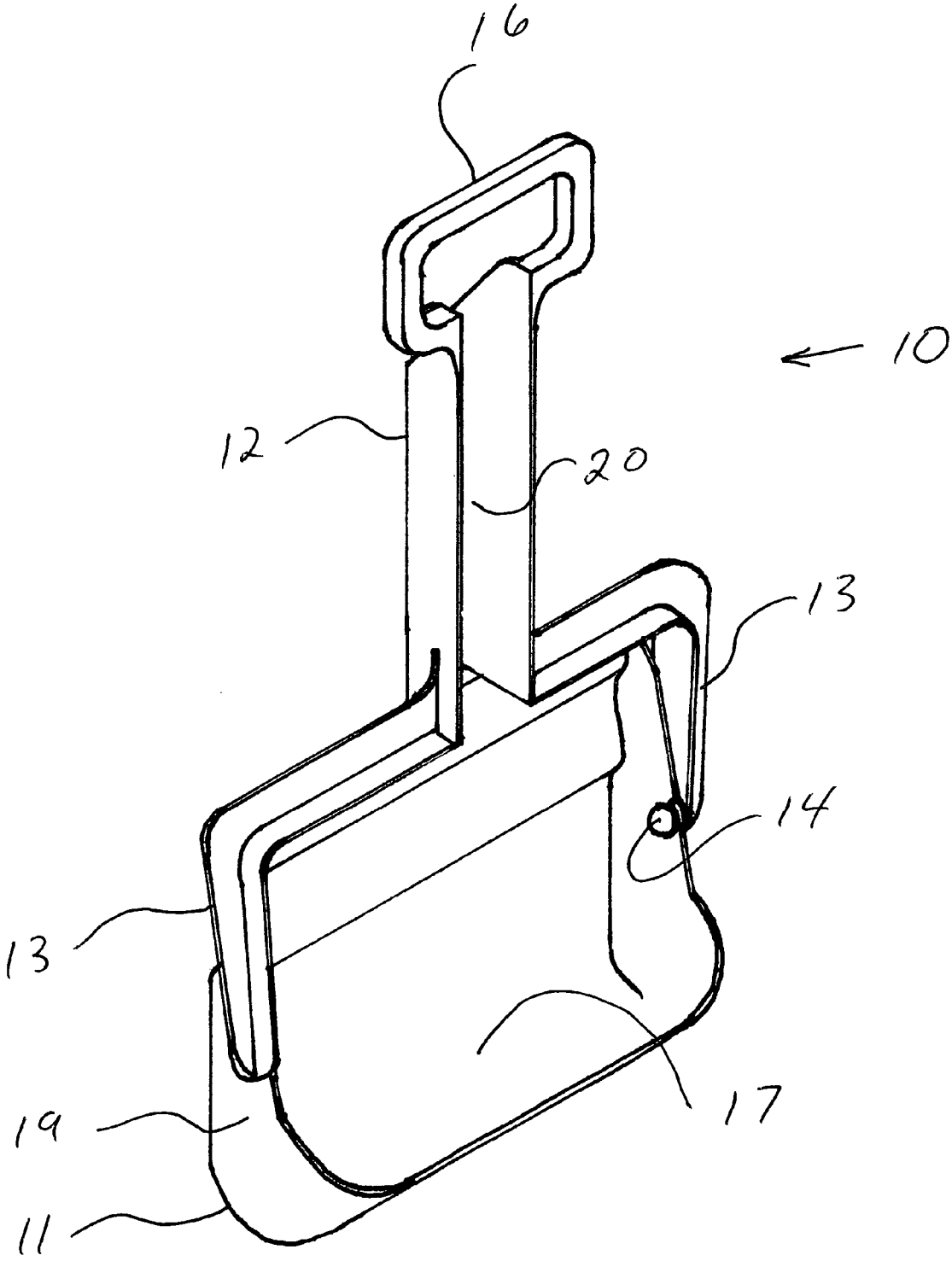
FIG. 8 is a three dimensional view of a dust pan in an upright position.

In conjunction with the described embodiment of the present invention is a dust pan 10 as shown in FIG. 7 and FIG. 8. The dust pan 10 has two separate but connecting components, a dust pan bucket 11 and a dust pan handle 12, made out of suitable materials. The dust pan handle 12 has two dust pan handle arms 13 which extend out of the dust pan handle 12 main body so to make the dustpan handle 12 to look like a two prong fork, the dustpan handle arms 13 lies on opposite sides of the dust pan bucket 11 main body perpendicular to the dust pan bucket entrance 18 as shown in FIG. 7. The dust pan handle arms 13 has two connecting pins 14 at its opposite ends from the connection to the dust pan handle 12 main body. The connecting pins 14 are attached to the dust pan bucket walls 19 allowing the dust pan handle 12 to swivel 15 back and forth in relation to the dust pan bucket 11 as shown in FIG. 7, so when the operator lifts the dust pan handle 12 by the finger hold 16 as shown in FIG. 7 the dust pan bucket 11 swivels upward preventing any aquired debris from falling out of the holding tray 17 as shown in FIG. 8.

Figure 9:
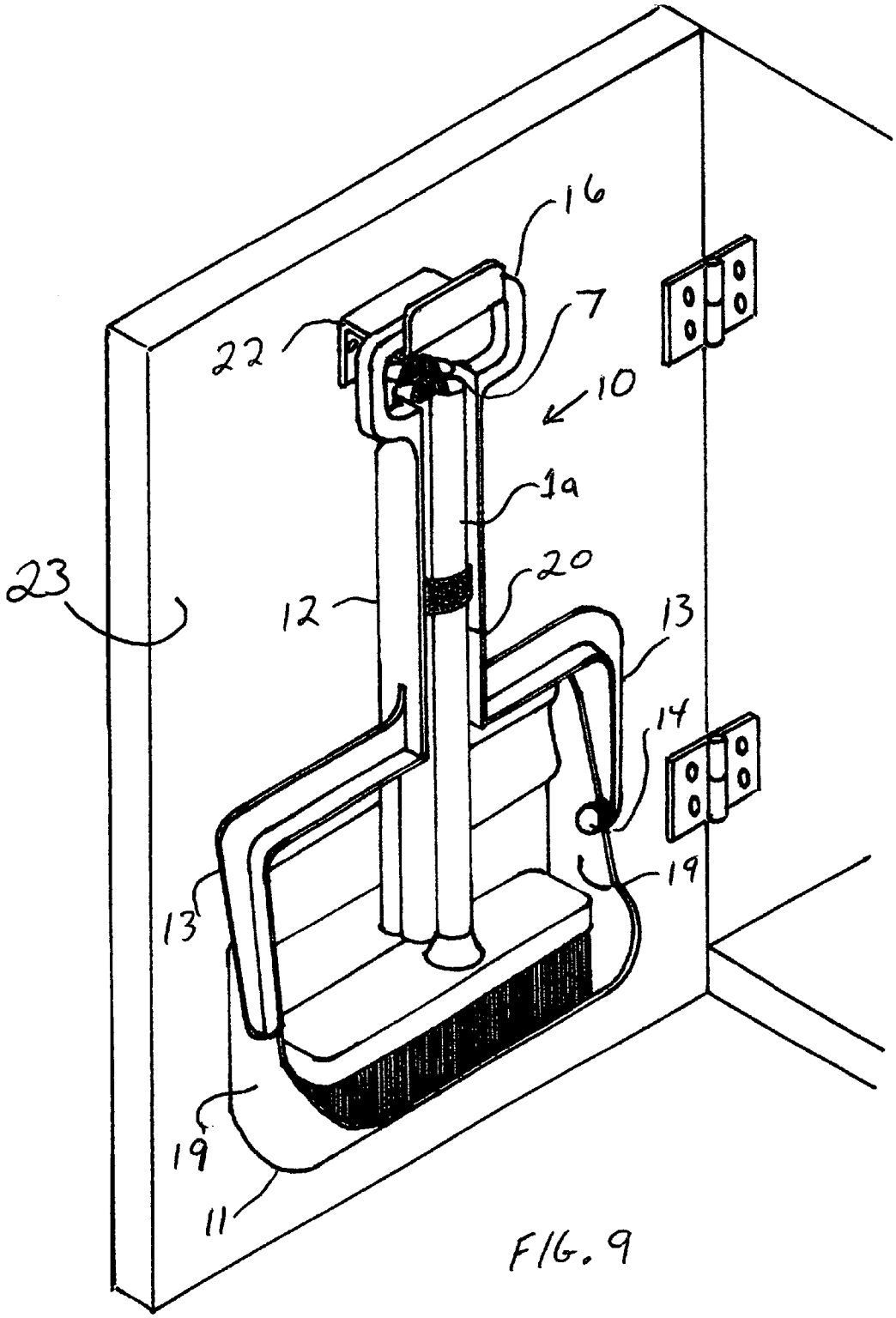
FIG. 9 is a three dimensional view of a dust pan interacting with a collapsible broom in a storage mode affixed to a cupboard door.

The dust pan handle 12 is an elongated body that is a U shaped channel 20 as shown in FIG. 8. This U shaped channel 20 has the width and depth to encompass the short handle 4*a* snuggly on three sides. Hence the broom 1*a* can be inserted into the dust pan 10, bristles 3 first into the holding tray 17, then the short handle 4*a* can be placed into the U shaped channel 20 which makes the configuration of a storage mode 21 as shown in FIG. 9. The Broom 1*a* and the dust pan 10 can be conveniently transported or stored in this storage mode 21. When the broom 1*a* and the dust pan 10 is in a storage mode 21 the finger hold 16 can be placed on a hook 22, made out of suitable materials, which has the attachment means to be placed on a hard surface such the inside of a door of a kitchen cupboard 23 as shown in FIG. 9. This allows the operator the choice of a full size or compact cleaning implement, and the convenience of compact transportation or storagability.

Those skilled in the art to which this invention relates to are able to do variations in its practice and modes of construction. Thus this invention is not intended to be limited by the illustrative description presented hereinabove, but should be encompassed in the spirit and scope of the appended claims.

What is claimed is:

1. A cleaning assemly comprising, in combination:

a) a broom comprising a collapsible handle with a broom head disposed at an end thereof, the handle comprising a plurality of generally tubular handle sections wherein adjacent handle sections are interfitted by a reduced diameter portion of one section being inserted into an end of the adjacent section, the handle sections being connected by an elastic cord located within the handle section and providing elastic pull which tends to hold the sections together, the handle sections when pulled apart adapted to be folded along side each other and fixed together to define a shorter handle;

b) a dust pan comprising a bucket, said bucket comprising a holding tray and a pair of side walls on opposite side of the tray, said dust pan further including a handle pivotally coupled to the bucket, said handle including a pair of arms at a first end therof the ends of which are pivotally coupled to respective side walls and a generally loop-shaped finger hold at a second end therof, the handle further including a U-shaped channel extending along the handle from the pair of arms at the first end to the finger hold at the second end and further wherein the grip portion defines a grip portion oriented transverse with respect to the U-shaped channel; and c) the broom being adapted to stored within the dust pan, with the broom head being received in the bucket and the shorter collapsed handle of the broom being received within the U-shaped channel.

* * * * *